US008943723B2

(12) United States Patent
Valentine et al.

(10) Patent No.: US 8,943,723 B2
(45) Date of Patent: Feb. 3, 2015

(54) DISPLAYS WITH MAGNETIC COUPLINGS

(71) Applicant: T3 Expo, LLC, Lakeville, MA (US)

(72) Inventors: Christopher Hugh Valentine, Marshfield, MA (US); Christopher James Hoffman, Hanson, MA (US)

(73) Assignee: T3 Expo, LLC, Lakeville, MA (US)

( * ) Notice: Subject to any disclaimer, the term of this patent is extended or adjusted under 35 U.S.C. 154(b) by 0 days.

(21) Appl. No.: 14/160,086

(22) Filed: Jan. 21, 2014

(65) Prior Publication Data

US 2014/0202054 A1 Jul. 24, 2014

Related U.S. Application Data

(60) Provisional application No. 61/754,267, filed on Jan. 18, 2013.

(51) Int. Cl.

| | |
|---|---|
| ***G09F 7/04*** | (2006.01) |
| ***G09F 15/00*** | (2006.01) |
| ***G09F 1/10*** | (2006.01) |
| *G09F 7/18* | (2006.01) |

(52) U.S. Cl.

CPC ..... *G09F 15/0012* (2013.01); *G09F 1/10* (2013.01); *G09F 7/04* (2013.01); *G09F 2007/1852* (2013.01); *Y10S 211/01* (2013.01)

USPC ..... 40/600; 40/611.01; 40/621; 211/189; 211/DIG. 1

(58) Field of Classification Search

CPC ..... G09F 7/04; G09F 19/22; G09F 2019/223; G09F 1/10; G09F 7/10

USPC ..... 40/600, 605, 611.01, 711, 661.01; 248/309.4, 683, 206.5, 467, 537; 335/285; 211/DIG. 1, 189

See application file for complete search history.

(56) References Cited

U.S. PATENT DOCUMENTS

| | | | | |
|---|---|---|---|---|
| 2,966,992 | A * | 1/1961 | Dunkelberger et al. | 211/70.7 |
| 3,024,392 | A * | 3/1962 | Baermann | 335/303 |
| 3,075,258 | A * | 1/1963 | Petkwitz | 49/478.1 |
| 3,420,017 | A * | 1/1969 | Brugger et al. | 52/220.5 |
| 4,451,321 | A * | 5/1984 | McKelvey | 156/382 |
| 4,912,864 | A * | 4/1990 | Price | 40/711 |
| 5,421,112 | A * | 6/1995 | Knorr | 40/600 |
| 2005/0145589 | A1 * | 7/2005 | Chen | 211/196 |

* cited by examiner

*Primary Examiner* — Casandra Davis
(74) *Attorney, Agent, or Firm* — Strategic Patents, P.C.

(57) ABSTRACT

The perimeter of a hollow-core nonmagnetic frame is magnetized with magnetic inserts. Display panels of corresponding shape and size are provided with a ferromagnetic material along their perimeter so that the display panels can be magnetically retained in position on the frame by magnetically coupling to the magnetic inserts through the nonmagnetic frame. In this manner, aesthetically pleasing seamless multi-panel displays can be created in various shapes and sizes.

15 Claims, 8 Drawing Sheets

DISPLAYS WITH MAGNETIC COUPLINGS

CROSS-REFERENCE TO RELATED APPLICATIONS

This application claims the benefit of U.S. Provisional Application No. 61/754,267 filed on Jan. 18, 2013, the entire content of which is hereby incorporated by reference.

FIELD OF THE INVENTION

This document generally relates to trade show display systems, and more specifically to a system and method for magnetically coupling display panels to a structural frame.

BACKGROUND

Conventional trade show displays use an extruded aluminum frame with grooves on one or more edges to retain a display panel through a friction fit or the like. These displays are relatively inexpensive and easy to assemble compared to permanent installations, however they constrain the visual presentation of material somewhat by necessarily leaving the aluminum framework exposed and visible. This aesthetic look of exposed aluminum framework, while commonplace in tradeshow displays, is not always desirable. In many contexts, a seamless, multi-panel assembly may be preferred.

Attempts to hide these seams have led to other display systems with panels that are taped, glued, or otherwise adhered together. However, these techniques suffer from a number of other disadvantages. They often lack the structural integrity of an aluminum framework, and the taping or other adhesives can irreversibly bond adjacent panels so that they cannot be disassembled/reassembled or adjusted and realigned once they have been assembled into a display. Further, direct panel-to-panel taping can result in warping of an aggregate display surface and other visual artifacts that disturb the seamless presentation of visual content.

There remains a need for improved systems and methods for assembling display panels into a display with seamless joints in a manner that permits disassembly and reassembly of the display for storage, transportation, and reuse.

SUMMARY

The perimeter of a hollow-core nonmagnetic frame is magnetized with magnetic inserts. Display panels of corresponding shape and size are provided with a ferromagnetic material along their perimeter so that the display panels can be magnetically retained in position on the frame by magnetically coupling to the magnetic inserts through the nonmagnetic frame. In this manner, aesthetically pleasing seamless multi-panel displays can be created in various shapes and sizes.

In one aspect, a display system disclosed herein includes a display panel having a front side for display and a back side, the display panel having a plane; a ferromagnetic material affixed to the back side of the display panel; a plurality of structural members forming a frame sized to contain the display panel, at least one of the plurality of structural members including a plurality of walls forming a hollow core in an interior thereof, the plurality of walls including an interior surface and an exterior surface, wherein the exterior surface of at least one of the plurality of walls is parallel to the plane of the display panel when the display panel is positioned on the frame; an insert shaped to fit within the hollow core of the at least one of the plurality of structural members; and a magnet affixed to the insert, the magnet having a suitable magnetic strength to magnetically couple the display panel to the insert through the at least one of the plurality of walls of the at least one of the plurality of structural members of the frame when the insert is disposed within the hollow core.

BRIEF DESCRIPTION OF THE DRAWINGS

The features of the invention will be apparent from the following description of particular embodiments thereof, as illustrated in the accompanying figures. The figures are not necessarily to scale, emphasis instead being placed upon illustrating the principles of the devices, systems, and methods described herein.

DETAILED DESCRIPTION

Figure 1A:
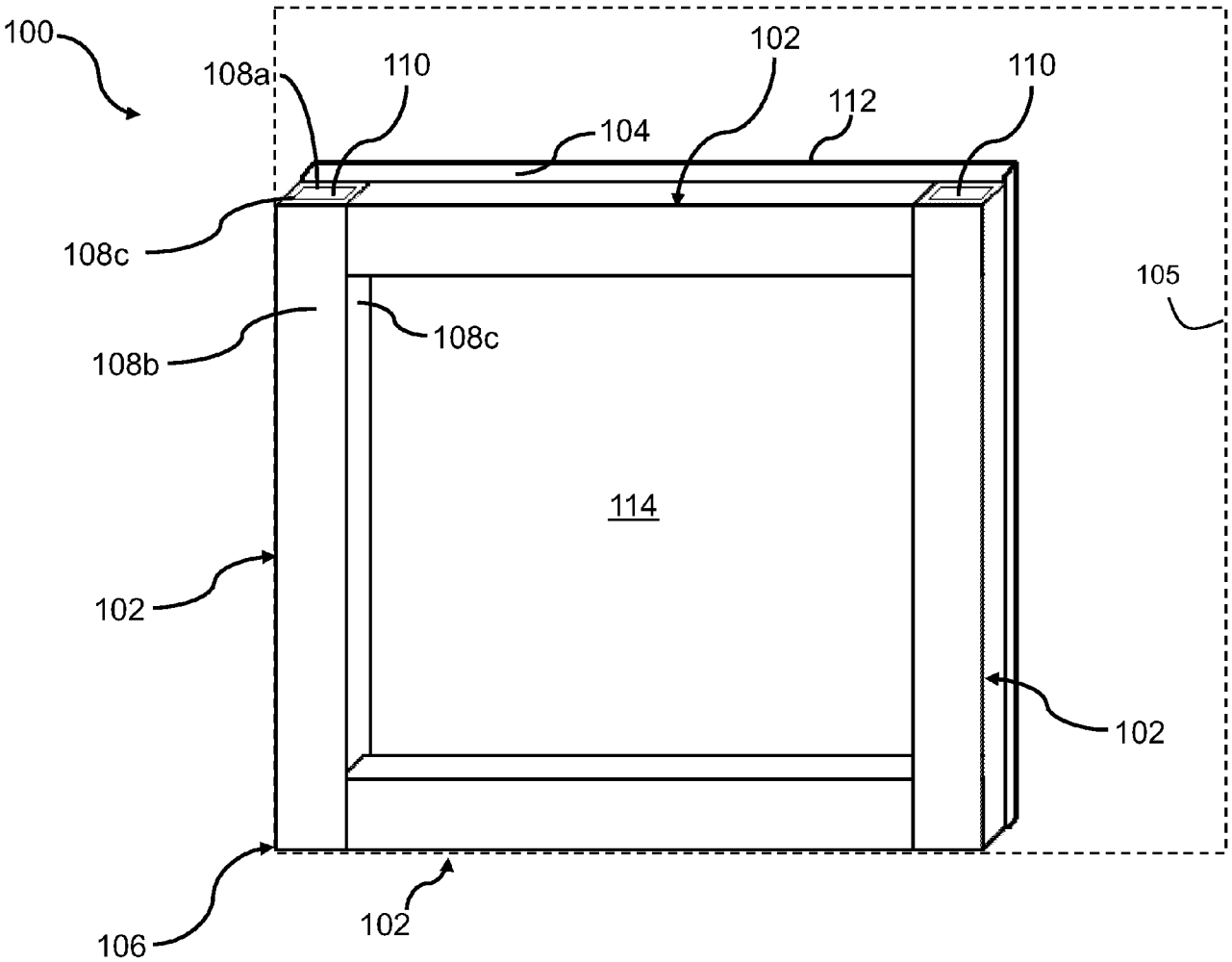
FIG. 1A shows a display system including a frame and a display panel.

All documents mentioned herein are hereby incorporated by reference in their entirety.

References to items in the singular should be understood to include items in the plural, and vice versa, unless explicitly stated otherwise or clear from the context. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

No language in the specification should be construed as indicating any unclaimed element as essential to the practice of the embodiments.

Recitation of ranges of values herein are not intended to be limiting, referring instead individually to any and all values falling within the range, unless otherwise indicated herein, and each separate value within such a range is incorporated into the specification as if it were individually recited herein. Similarly, a recitation of a specific value is not intended to be limiting unless specifically stated to the contrary. Words such as "about," "approximately" or the like, when accompanying a numerical value, are to be construed as including any deviation as would be understood by one of ordinary skill in the art to operate satisfactorily for an intended purpose. Similarly, words such as "substantially" are intended to indicate any ordinary variability as would be expected by one of ordinary skill in the art consistent with the intended operation of the disclosed embodiments. At the same time, the absence of such qualifying language is not intended to require precise identity with the described feature, but is instead intended to include any reasonable range of variability as might be expected by one of ordinary skill.

In the following description, it is understood that terms such as "front," "back," "top," "bottom," "side," "first," "second," and the like, are words of convenience and are not to be construed as limiting terms.

Described herein are various display systems. The "display," "system," or "display system," as described herein shall refer to a system for displaying one or more display panels, which may include, for example, a display panel and a structural frame. The "display panel" or "panel" may be any item for presentation at, e.g., a tradeshow, convention, corporate event, sporting event, conference, exhibition, general event, retail store, restaurant, bar, or any other setting in which one might want to provide information or aesthetic content. The display panel may include, without limitation, a sign, graphic, advertisement, identification, poster, billboard, and so on. The display panel may further include, without limitation, lettering, designs, numbers, colors, graphics and the like. The display panel may also or instead include digital signage including, without limitation, a computer screen, an LED screen, an OLED screen, a plasma screen, an LCD screen, and so on. The display panel may also or instead include electrical components including, without limitation, light fixtures, clocks, LEDs, tickers, and the like. The display panel may also include interactive or moving elements. The display panels may be made from any material known in the art or that will become known in the art, including, without limitation, paper, wood, foam, plastic (e.g., corrugated plastic), cardboard, honeycomb cardboard, metal, and so on. The display panels may also be magnetic or nonmagnetic. The displays may include temporary displays such as temporary booths, exhibits, showcases, partitions, and the like. The displays may also be interchangeable, movable, and/or adaptable (e.g., able to change size, shape, setting, appearance, etc.).

FIG. 1A shows a display system 100 including structural members 102 for supporting a display panel 104. The structural members 102 may form a frame 106 shaped and sized to fit the display panel 104. The structural members 102 may include walls (e.g., a front wall 108*a*, back wall 108*b*, and side walls 108*c*) forming a hollow core 110 in an interior of each structural member 102, with the core 110 surrounded by the interior surfaces of the walls 108*a*-108*c*. The hollow core 110 need not be completely hollow, or even mostly hollow, and may include various solid features therein. However, the hollow core 110 is preferably hollow along most or all of its length, as in an extruded structure, to facilitate the insertion and removal of magnetized inserts as contemplated herein.

The structural members 102 may be formed of a nonmagnetic material so that the magnetic forces from magnets inside the hollow core 110 can couple to a ferromagnetic material on the display panel 104. This combination of magnetic material inside the hollow core 110, a nonmagnetic frame structure, and a ferromagnetic material on the display panel 104 permits the display panel 104 to be removably and replaceably affixed to the frame 106 for presentation.

The display panel 104 may include a front side 112 for display, and a back side 114 for securing to the frame 106. The display panel 104 may further include a plane 105 that runs parallel to either or both of the front side 112 and the back side 114 of the display panel 104. In general, this plane 105 is not intended to require strict planarity in the display panel 104 or the frame 106. Instead, this plane 105 provides a conceptual surface for describing the relative orientation of the various components of a display system 100 discussed herein.

FIG. 1A shows a rear view of the display system 100, where the back side 114 of the display panel 104 is positioned on the frame 106. The display panel 104 may engage with the exterior surfaces of the front walls 108*a* of the frame 106 and magnetically couple to magnets in the core 110 through a front wall 108*a* of a structural member 102. The exterior surfaces of the front walls 108*a* may be substantially parallel to the plane 105 of the display panel 104 when the display panel 104 is positioned on the frame 106. The frame 106 may be shaped and sized to fit the display panel 104. In one aspect, the display panel 104 may include a perimeter in the plane 105 equal in size and shape to a perimeter of the frame 106. It will be understood that the relative shape and size of the display panel 104 and frame 106 may vary in multipanel configurations. For example, where two parallel panels abut in a multipanel arrangement, the display panel 104 may only cover one half of the front wall 108*a* of a structural member 102, leaving the other half open for an adjacent panel. In other embodiments, the structural members 102 may be placed immediately adjacent to one another so that each display panel 104 has an independent frame 106 with a size matching the display panel 104.

Figure 1B:
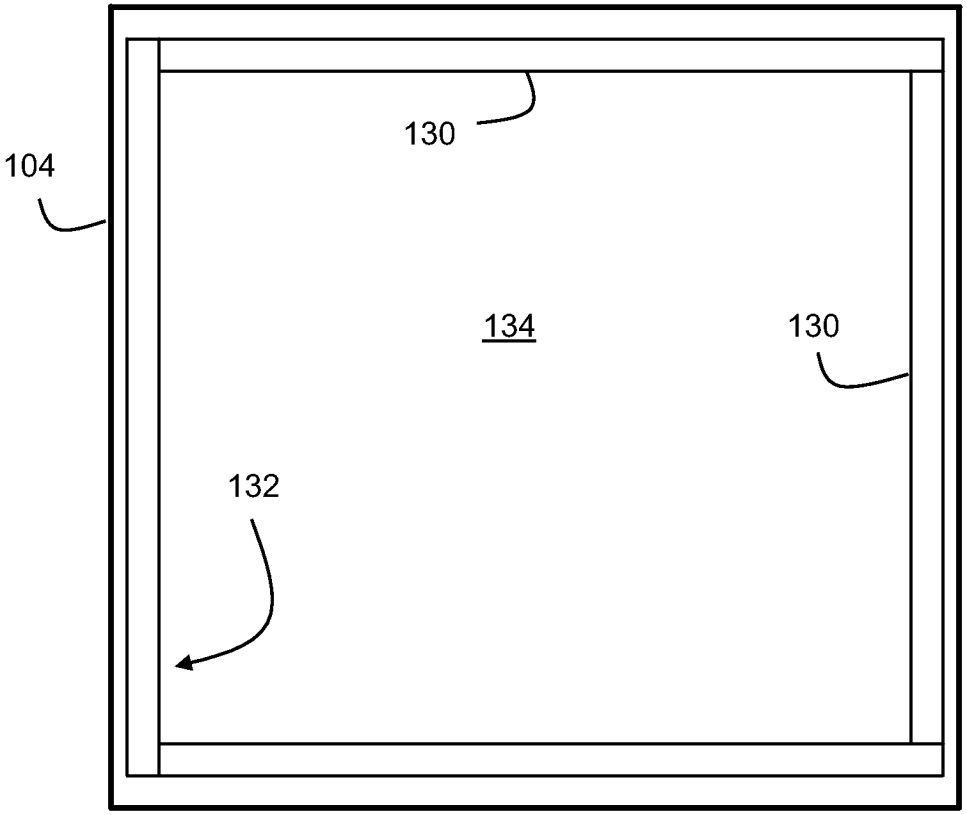
FIG. 1B shows a display panel.

FIG. 1B shows a display panel such as the display panel described above. The display panel 104 may include a band of ferromagnetic material 130 distributed on a surface thereof. In particular, the band of ferromagnetic material 130 may be distributed about a perimeter 132 of the display panel 104 on a back surface 134—the surface of the display panel 104 placed in contact with a frame. The frame 106 may be extruded aluminum, extruded plastic, or any other nonmagnetic material that provides structural integrity to a frame without interfering with the magnetic forces of magnets in the interior thereof. The band of ferromagnetic material 130 may be nonmagnetized so that it can be magnetically coupled to the magnets in any orientation, e.g., so that the display panel 104 can be moved about on the frame 106, or the ferromagnetic material 130 may be magnetized, e.g., to increase the magnetic forces coupling the display panel 104 to the magnets through the frame 106. While a magnetized material on the display panel 104 can increase the coupling forces retaining the display panel 104 on the frame, this may also impose a preferred orientation of the display panel 104 on the frame 106, which may be an advantage or a disadvantage depending upon the intended use. Further, while depicted as a continuous band about the perimeter of the display panel 104, it will be understood that one or more ferromagnetic materials may be disposed on the display panel 104 as discrete segments of such material, fixed magnets, and so forth.

The band of ferromagnetic material 130 may also or instead include a metal band that can be attracted by a magnetic field, and in particular the magnetic field of a fixed magnet passing through a wall of a structural member. For example, a thin (e.g., 0.031") steel strapping may be conveniently used as a metal band. The thin metal band allows a display panel to rest in a very close physical proximity to the exterior wall of the structural member, which facilitates the seamless coupling of adjacent display panels in a larger display assembly. A strong, thin, double-sided tape or other suitable adhesive may be used to secure the band of ferromagnetic material 130 to the display panel 104, or a magnetic tape with an adhesive surface may be used.

Figure 2:
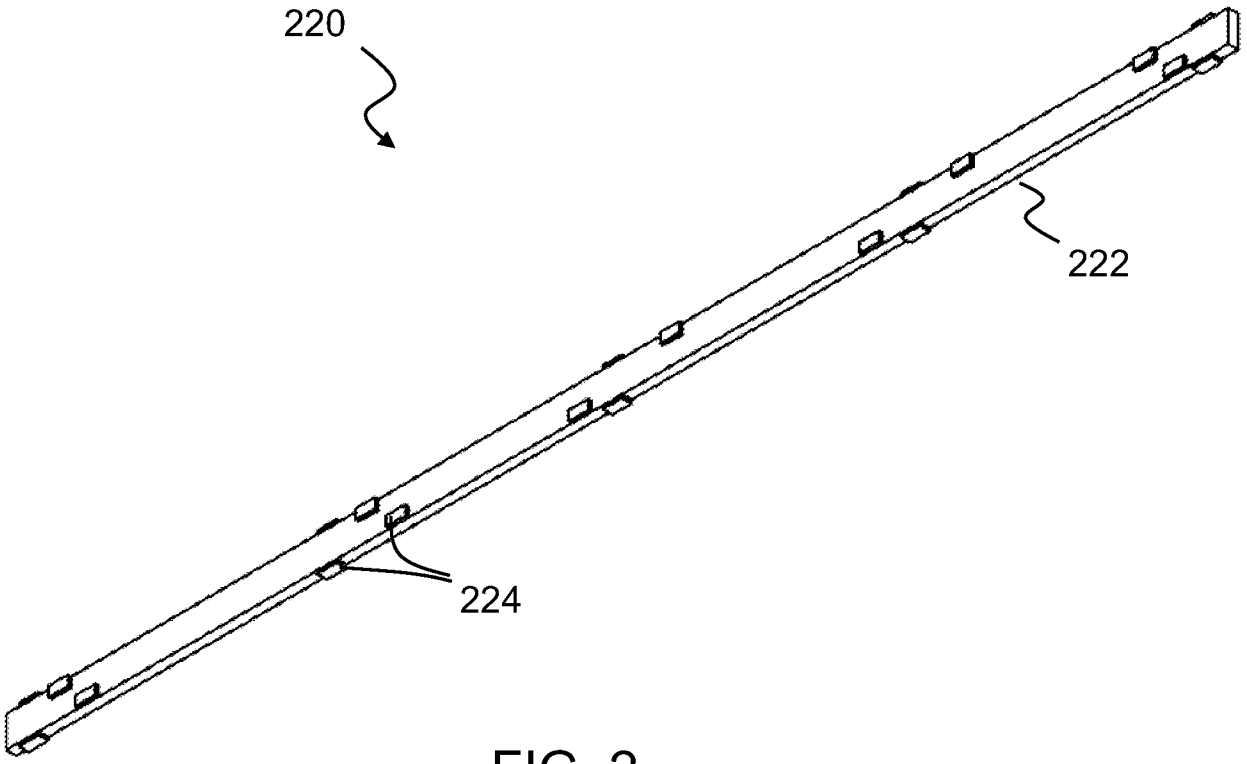
FIG. 2 shows an insert for a frame.

FIG. 2 depicts an insert 220, which may be shaped to fit within the hollow core of a structural member of the display system.

The insert 220 may include a core 222 of foam or any other suitably workable material that may be shaped to fit within a structural member of a display system. The insert 220 may be sized to form a light friction fit with one or more of the interior walls of the structural member. The insert 220 may include one or more magnets 224 affixed to the core 222 of the insert 220 by any suitable means such as adhesives, tape, screws, clamps, fasteners, and so on.

The magnets 224 may, for example, be any magnets having a suitable magnetic strength to magnetically couple a display panel to the insert 220 through a wall of one of the structural members when the insert 220 is disposed within the hollow core of the structural member. The magnets 224 also preferably engage a display panel with a weak enough force that a display panel can—after being placed for use on the frame— be removed or positionally adjusted without damaging the display panel. A variety of magnets are known in the art and suitable for use with the insert 220 as contemplated herein.

The magnets 224 may, for example, include fixed magnets such as rare earth magnets formed of a material such as rare earth neodymium. This commercially available material usefully provides a compact form factor with a strong magnetic force. The magnets 224 may also or instead include other rare earth magnets such as a samarium-cobalt magnet and a neodymium-iron-boron magnet, or any other magnetic material capable of providing magnetic forces sufficient to secure a ferromagnetic material through a wall of a structural member in a manner that can retain a display panel in a desired position. The magnets 224 preferably have a sufficient strength to magnetically couple a display panel to the insert 220 (and/or the magnets 224) through a wall of a structural member of the frame when the insert 220 is disposed within a hollow core of the structural member. In an implementation, a spacing of at least five magnets 222 (e.g., neodymium magnets) per eight feet of display panel edge adequately secures a display panel of quarter inch foam against a structural member of extruded aluminum having a wall thickness of about 0.0625 inches to about 0.125 inches. It will be appreciated that a precise amount of force is not required. Rather, one of skill in the art can select magnets, ferromagnetic materials, display panels and wall thicknesses (for the structural members) to provide sufficient magnetic field strength and pull force to retain a display panel under a variety of expected conditions.

Figure 3A:
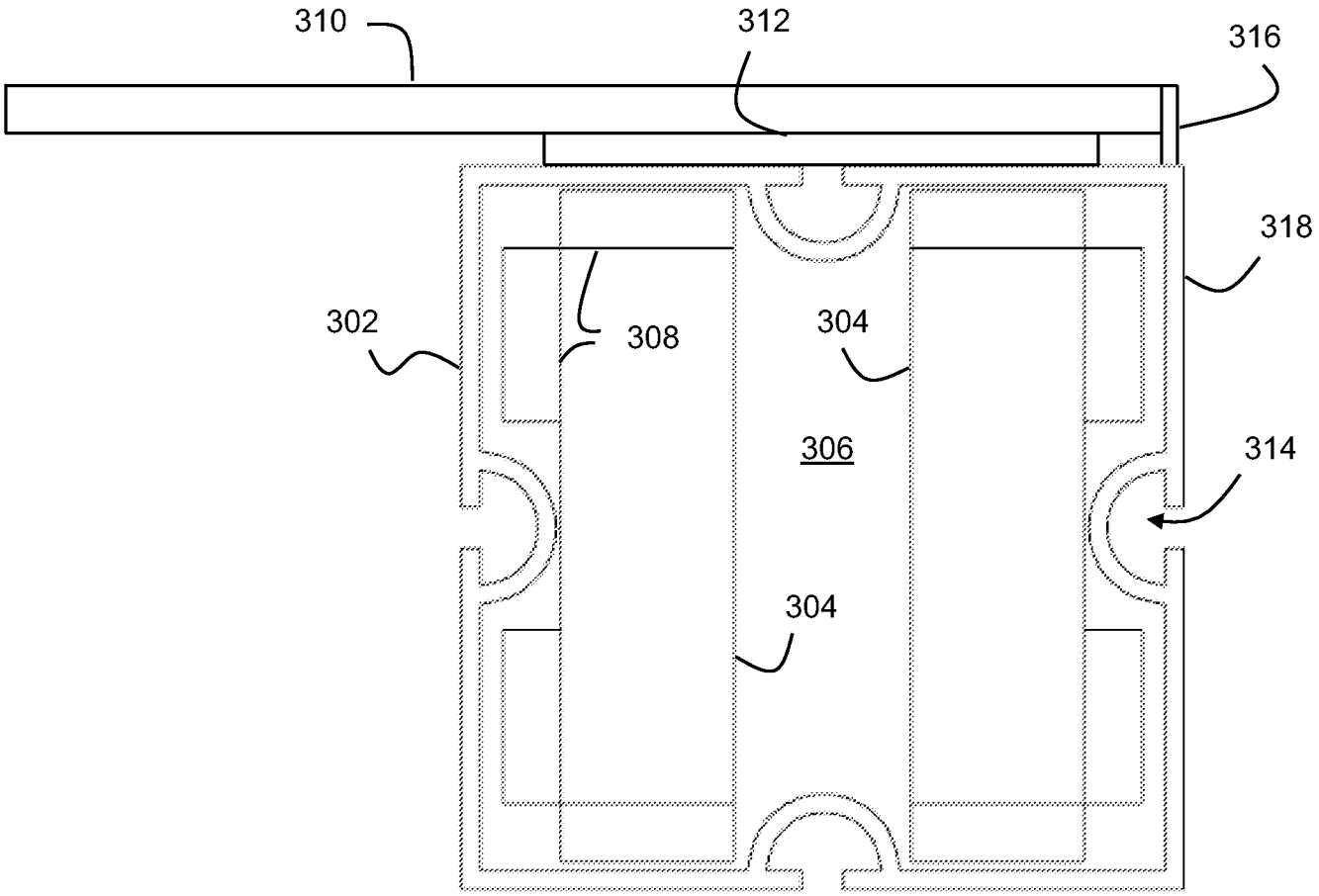
FIG. 3A is a cross section of a structural member with an insert.

FIG. 3A is a cross section of a structural member and a display panel. The structural member 302 may be formed of extruded aluminum, extruded plastic, or any other suitable material, and may form a number of walls about a hollow interior. While illustrated as a square, it will be understood that the cross-sectional profile of the structural member may be any other shape, such as triangular, hexagonal, or any other regular or irregular polygonal shape suitable for use in a display.

An insert 304 such as any of the inserts described above may be friction fit or otherwise retained within an interior 306 of the structural member 302. The insert 304 may have a core of foam or the like as generally described above, and may include one or more magnets 308 adhered or otherwise attached thereto in positions so that the magnets 308 abut an interior surface of the structural member when the insert 304 is placed in the interior 306. It will be understood that while two inserts are shown in FIG. 3A, any number of inserts may usefully be employed. For example, a single insert may be used that provides magnets to some or all of the planar surfaces of the structural member 302, or three or more inserts may be used. The use of multiple, independent inserts permits magnets to be placed only adjacent to those surfaces of the structural member 302 that will receive a display panel.

The interior 306 may be a hollow air core or the like. In general, the interior 306 formed by the walls 318 of the structural member 302 may be completely hollow or partially hollow. The interior 306 may also or instead be filled with a material such as a gel, putty, foam, form-fitting material or the like that can retain magnets 308 in desired positions within the structural member 302, either with or without an insert 304 that is secured to the magnets 308.

The display panel 310 may be any of the display panels described herein. The display panel 310 may have a ferromagnetic material 312 disposed on a surface thereof, such as a magnetic tape, steel tape, or the like. The ferromagnetic material 312 may be affixed to the display panel 310 by any means known in the art (e.g., adhesive, tape, screws, clamps, fasteners, and so on). The ferromagnetic material 312 may include a band of ferromagnetic material such as a commercially available magnetic tape. The ferromagnetic material 312 may be magnetized or nonmagnetized. Alternatively, or in addition to a band of material, the ferromagnetic material may include multiple magnets such as the rare earth magnets described above.

The structural member 302 may also include any number of mechanical features 314 such as a channel to facilitate assembly of the structural member 302 with other structural members into a larger display.

The structural member 302 may optionally include a flange 316 extending from a wall 318 on an exterior surface of the structural member 302. The flange 316 may usefully provide an alignment guide for the display panel 310 when placed for use on a frame. Where a number of structural members 302 form a perimeter of a frame, exterior surfaces of the structural members 302 that engage a back side of the display panel 310 (e.g., where the ferromagnetic material is disposed) may each include a flange along the perimeter of the frame in order to deterministically position the display panel 310 within the frame. At the same time, the flange 316 may usefully be omitted to provide a seamless joint to an adjacent display panel. The frame may also or instead include other forms of alignment guides that are known in the art, including, but not limited to joints, pins, snaps, dowels, and the like, as well as any mechanical registration feature that urges a display panel into a predetermined alignment on the frame.

Figure 3B:
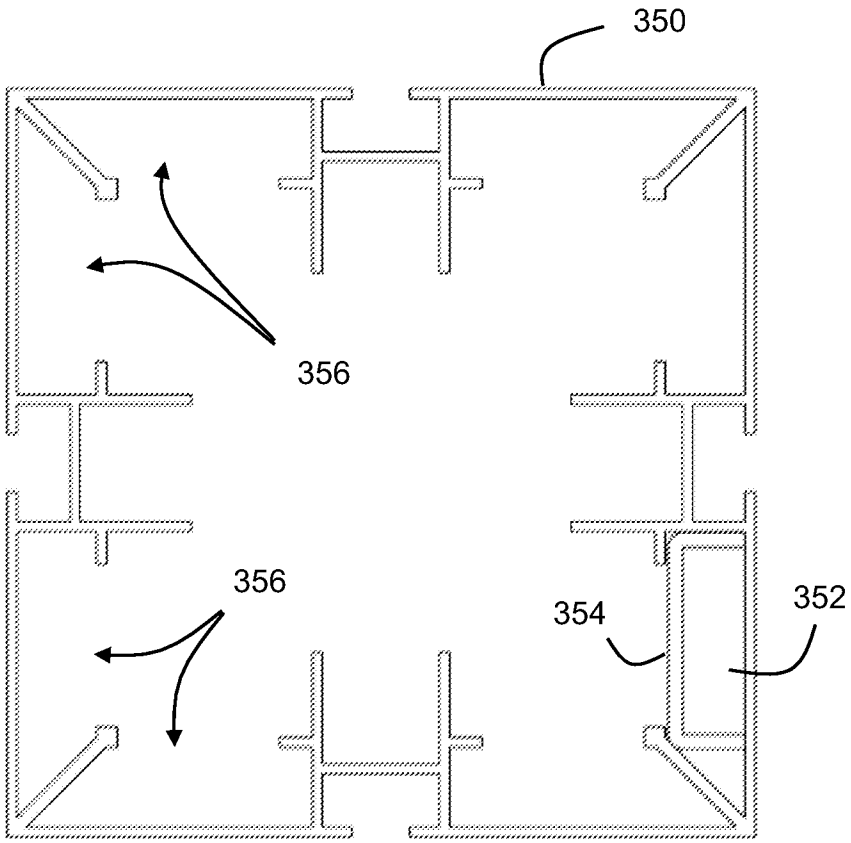
FIG. 3B is a cross section of a structural member with an insert.

FIG. 3B is a cross section of a structural member with an insert. The structural member 350 may be any of the structural members described herein, and may be formed, for example, of extruded aluminum or plastic. As shown in FIG. 3B, a separate retaining mechanism may be provided so that magnets 352 can be independently inserted and removed in various locations about a perimeter of the cross section. In particular, an insert 354 may be formed of a U-channel shaped to retain a column of magnets in one of a number of different possible positions 356 about the perimeter of a cross-section of the structural member 350. This approach provides numerous advantages. Where the insert 354 is formed of steel or a similarly ferromagnetic material, a magnet 352 can be conveniently affixed to the insert 354 using the magnetic force of the magnet 352. Also, a steel insert will tend to favorably distribute the magnetic field from a number of fixed magnets along its entire length in order to better retain a display panel as contemplated herein. Further, this permits rapid reconfiguration of the structural member 350 for use in inside corners, outside corners, middle sections of flat walls, or two-sided flat displays.

Figure 4:
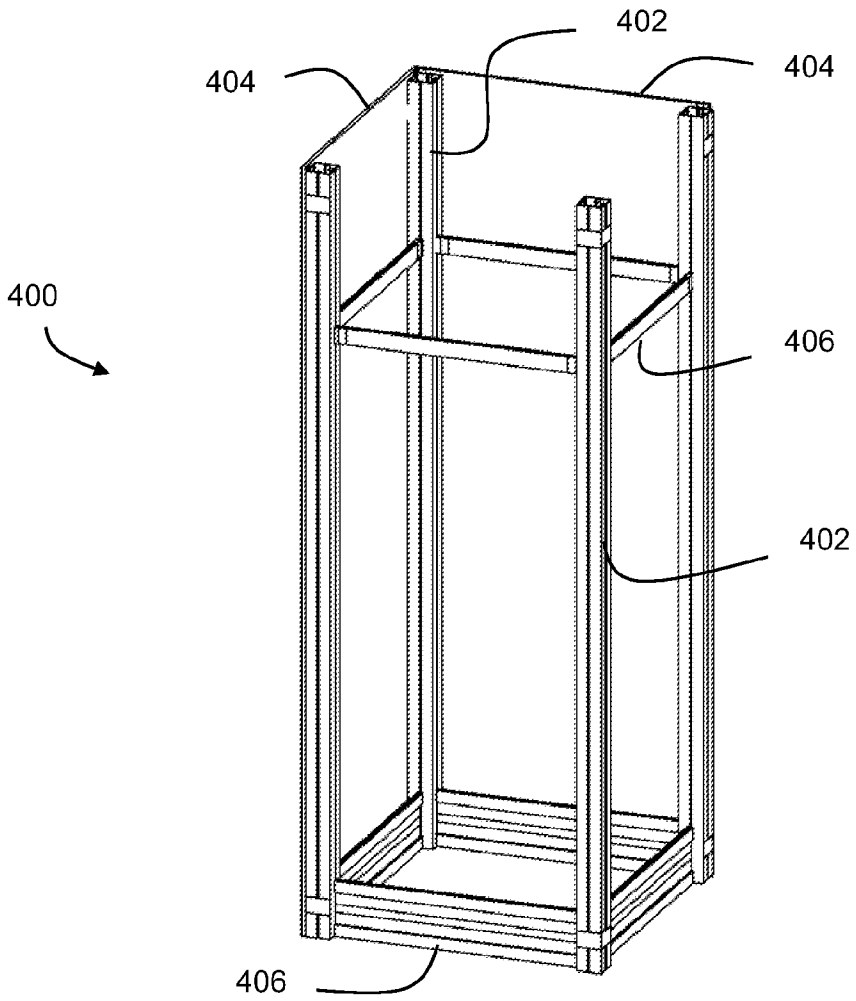
FIG. 4 shows a display.

FIG. 4 shows a display assembled using the techniques described herein. In general, the display 400 may include one or more structural members 402, one or more display panels 404, and one or more braces 406. In general, the structural members 402 and display panels 404 may be as described herein. The structural members 402 may be formed of a substantially nonmagnetic material with a hollow core that receives an insert with rare earth magnets disposed thereon. The display panels 404 may each include visual content for display on an outer surface, and a ferromagnetic material about a perimeter of an inner surface positioned so that the ferromagnetic material is proximal to the magnets of the inserts when placed for use on the display 400. While four structural members 402 and two display panels 404 are depicted, it will be appreciated that any number of structural members 402 and display panels 404 may be used in a display 400 according to a desired visual a spatial effect.

The braces 406 may serve to secure the structural members 402 in a desired two-dimensional or three-dimensional configuration. The braces 406 may be formed of extruded aluminum, extruded plastic, or any other metal, plastic, wood or other material or combination of materials suitable for rigidly supporting the display 400 in a desired structural configuration. In one aspect, the braces 406 may include fittings to couple to mechanical features such as grooves, holes, or the like in the support members 402 to facilitate assembly into the display 400.

Figure 5:
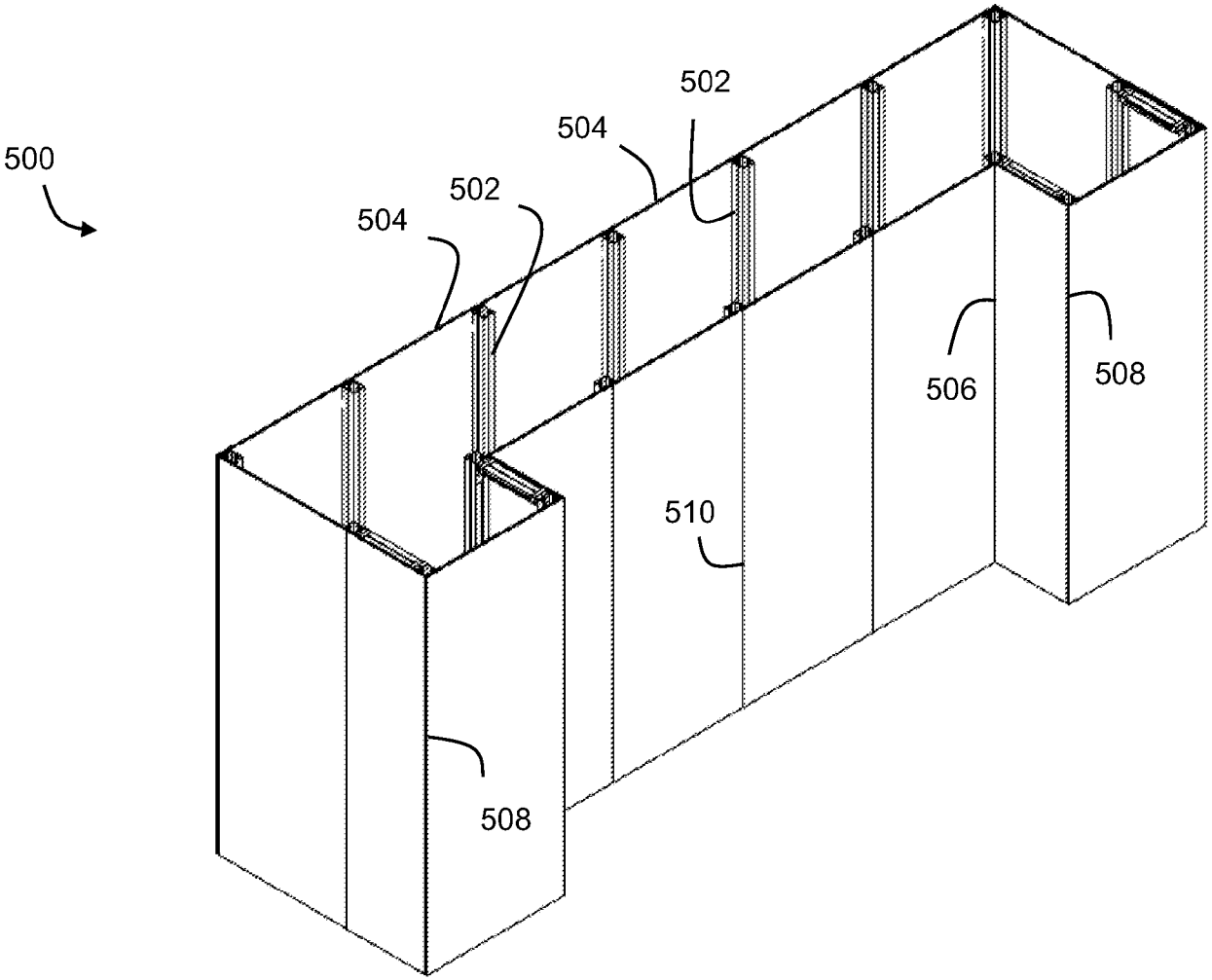
FIG. 5 shows a display.

FIG. 5 shows a display. The display 500 may be formed of a number of support member 502, display panels 504, and braces (not shown), with the support members 502 secured by the braces in any desired three-dimensional configuration. Through the use of magnetic couplings as described above, the display panels 504 may be assembled into a visually seamless arrangement of display panels 504 that spans seams at joints 506 on inner angles, joints 508 on outer angles 508 and joints 510 between adjacent, parallel panels. The display panels 504 at the joints 506, 608 on angled portions of the display 500 may be beveled or otherwise shaped to improve a fit between adjacent panels. The display panels 504 at the joints 510 between adjacent, parallel panels may also be shaped, e.g., with a tongue and groove or other complementary shape(s), to mechanically mate and couple along the seam 510 for a smoother, more continuous finish. It will be understood that in this context, seamless or visually seamless does not necessarily mean that each seam is completely invisible (although the visibility can be mitigated by careful attention to visual content and edge shape of the display panels 504). Instead, the term "seamless" is intended to indicate that no structural element is visible between the display panels 504 to secure the display panels 504 to one another. That is, no structural members, taping, screws, flanges, or other visible mechanical aspects are required to retain the display panels 504 within the display 500.

Figure 6:
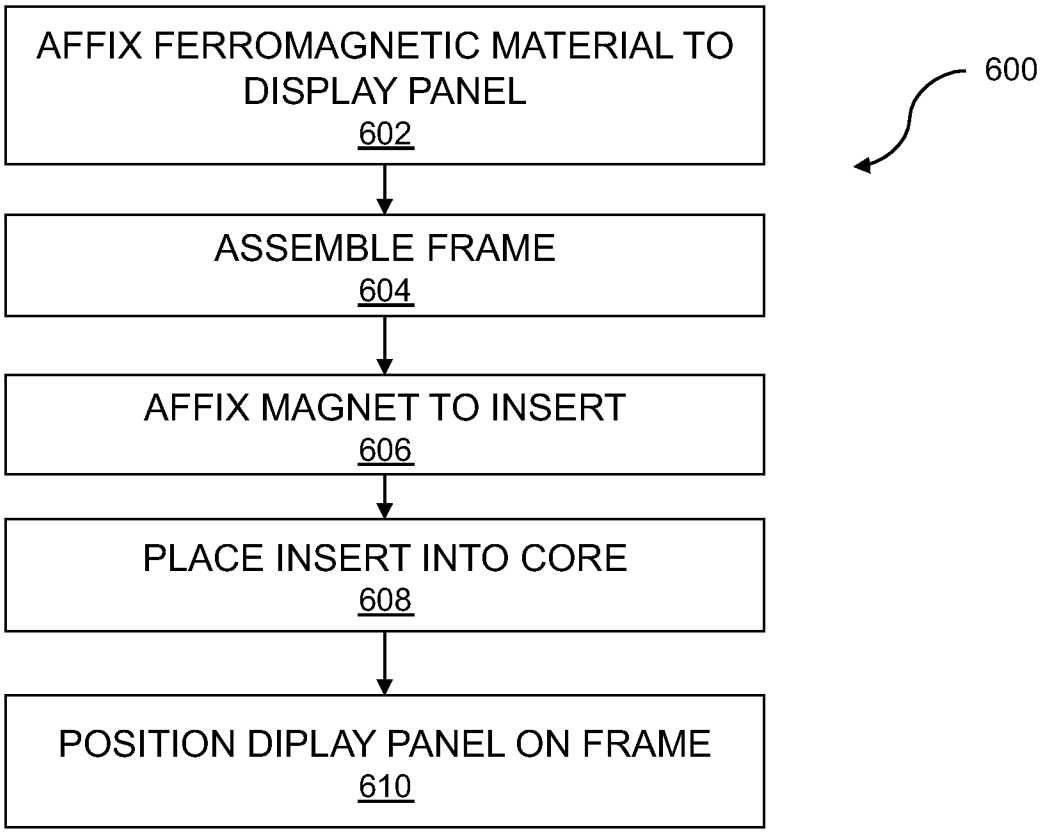
FIG. 6 is a flow chart of a method for using a display panel.

FIG. 6 is a flow chart of a method 600 for using a display panel.

As shown in step 602, the method 600 may include affixing a ferromagnetic material to the back side of a display panel. The ferromagnetic material may be a magnetic tape with an adhesive backing, so that the ferromagnetic material can be simply disposed onto the display panel in a desired location. In another aspect, the ferromagnetic material may a strip of magnetized or nonmagnetized ferromagnetic material without adhesive, and the strip may be adhered to the panel using any suitable glue, epoxy or other adhesive.

As shown in step 604, the method 600 may include arranging structural members into a frame shaped and sized to fit the display panel. At least one of the structural members may include walls that form a hollow core in an interior thereof. The walls include an interior surface and an exterior surface, where the exterior surface of at least one of the walls is substantially parallel to a plane of the display panel when the display panel is positioned on the frame.

As shown in step 606, the method 600 may include affixing a magnet to an insert shaped to fit within the hollow core of the structural member. The magnet may be positioned to align with the ferromagnetic material on the display panel when the insert is placed into the core of the structural member and the display panel is placed for use on the frame. Any number of magnets may be suitably employed according to a desired or required force to retain the display panel on the frame.

As shown in step 608, the method 600 may include inserting the insert into the hollow core of the structural member. The insert may be retained within the core with a friction fit, or retaining caps or the like may be used on the structural member to retain the insert in a desired position within the core.

As shown in step 610, the method 600 may include positioning the display panel on the frame, which magnetically couples the display panel to the insert through the wall of the structural member.

The foregoing method may be repeated any number of times. For example, where an angled joint is used, the method may include affixing magnets to a side of the insert proximal to an adjacent wall of one of the structural members, i.e., with magnets on two or more sides of the insert including a front wall and a side wall. A ferromagnetic material may then be affixed to a second display panel—a "side" display panel—and the second panel may be coupled to the frame to form a joint between the (front) panel and the side panel. This process may be continued with any number of frames, which may be coupled together with braces as described above or coupled directly to one another (e.g., where to adjacent panels are butt jointed to one another) in any number and arrangement, and any number of display panels, which may be coupled to the structural members to form a display.

In various embodiments, a single display panel may engage with multiple walls of the structural member. For example, the display panel may include a corner or rounded edge, where two or more surfaces of a single display panel engage with two or more exterior surfaces of the structural member. This may aid in forming a seamless appearance at an edge of the display. Also, the systems described herein may include multiple display panels that engage with a single wall of a structural member, such as where a butt joint formed between two adjacent panels is centered on one of the structural members. Further, an implementation includes a display system with magnets affixed to two or more inserts so that opposing sides of a structural member are both magnetized. In this manner, a frame can have a front display panel and a rear display panel, where both are magnetically coupled to the structural frame. More generally, magnets, structural members and display panels may be arranged in any suitable combination for a desired display effect.

It will also be understood that the principles of the invention may be applied in other configurations. For example, the structural members of the frame may themselves be magnetized, or fixed magnets may be adhered to the structural member without any use of inserts. Countersinks or the like may be used in the structural member to retain magnets in desired location. Thus, while the embodiments described above make advantageous use of readily available extruded aluminum structural members, other configurations are possible consistent with the principles of the invention disclosed herein, and all such variations are intended to fall within the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A display system comprising:

a display panel having a front side for display and a back side, the display panel having a plane;

a ferromagnetic material affixed to the back side of the display panel;

a plurality of structural members comprising extruded aluminum, the plurality of structural members forming a frame sized to contain the display panel, at least one of the plurality of structural members including a plurality of walls forming a hollow core in an interior thereof, the plurality of walls including an interior surface and an exterior surface, wherein the exterior surface of at least one of the plurality of walls is parallel to the plane of the display panel when the display panel is positioned on the frame;

an insert comprising a foam material, the insert shaped to fit within the hollow core of the at least one of the plurality of structural members; and a magnet affixed to the insert, the magnet having a suitable magnetic strength to magnetically couple the display panel to the insert through the at least one of the plurality of walls of the at least one of the plurality of structural members of the frame when the insert is disposed within the hollow core.

2. The display system of claim 1 wherein the ferromagnetic material is a metal band affixed to the back side of the display panel using an adhesive.

3. The display system of claim 2 wherein the metal band is a steel strapping.

4. The display system of claim 1 wherein the display panel has a substantially seamless appearance on the frame when the display panel is magnetically coupled to the insert through the at least one of the plurality of walls.

5. The display system of claim 1 wherein the insert is sized to form a friction fit with the interior surface of the plurality of walls when the insert is disposed within the hollow core.

6. The display system of claim 1 wherein the magnet comprises a rare earth magnet.

7. The display system of claim 6 wherein the magnet comprises at least one of a samarium-cobalt magnet and a neodymium-iron-boron magnet.

8. The display system of claim 1 wherein the plurality of walls of the structural member include a front wall and a rear wall, and the display system further comprises a plurality of magnets affixed to the insert, the plurality of magnets arranged on two or more sides of the insert to provide at least the front wall and the rear wall with magnetic surfaces.

9. The display system of claim 1 further comprising at least five magnets for every eight feet of an edge of the display panel.

10. The display system of claim 1 wherein the display panel has a perimeter in the plane equal in size and shape to a perimeter of the frame.

11. A method comprising:

affixing a ferromagnetic material to a back side of a display panel;

arranging a plurality of structural members into a frame sized to display the display panel, at least one of the plurality of structural members including a plurality of walls forming a hollow core in an interior thereof, the plurality of walls including an interior surface and an exterior surface, wherein the exterior surface of at least one of the plurality of walls is parallel to a plane of the display panel when the display panel is positioned on the frame;

affixing a plurality of magnets to an insert shaped to fit within the hollow core of the at least one of the plurality of structural members;

inserting the insert into the hollow core of the at least one of the plurality of structural members, wherein the plurality of walls of the structural member includes a front wall and a side wall, and wherein the plurality of magnets are arranged on two or more sides of the insert to provide at least the front wall and the side wall with magnetic surfaces;

positioning the display panel on the frame thereby magnetically coupling the display panel to the insert through the at least one of the plurality of walls of the at least one of the plurality of structural members of the frame;

affixing a ferromagnetic material to a back side of a side display panel, the side display panel including a plane that intersects the plane of the display panel, wherein the side wall of the structural member is parallel to the plane of the side display panel when the side display panel is positioned on the side wall; and positioning the side display panel such that the back side of the side display panel engages the side wall of the structural member such that the side display panel is magnetically coupled to the insert through the side wall.

12. The method of claim 11 wherein the ferromagnetic material is a metal band including a steel strapping.

13. The method of claim 11 wherein the insert is sized to form a friction fit with the interior surface of the plurality of walls when the insert is inserted into the hollow core.

14. A display system comprising:

a display panel having a front side for display and a back side, the display panel having a plane;

a ferromagnetic material affixed to the back side of the display panel;

a plurality of structural members forming a frame sized to contain the display panel, at least one of the plurality of structural members including a plurality of walls forming a hollow core in an interior thereof, the plurality of walls including a front wall and a side wall each having an interior surface and an exterior surface, wherein the exterior surface of at least one of the plurality of walls is parallel to the plane of the display panel when the display panel is positioned on the frame;

an insert shaped to fit within the hollow core of the at least one of the plurality of structural members;

a plurality of magnets affixed to the insert, the plurality of magnets arranged on two or more sides of the insert to provide at least the front wall and the side wall with magnetic surfaces, the plurality of magnets having a suitable magnetic strength to magnetically couple the display panel to the insert through the at least one of the plurality of walls of the at least one of the plurality of structural members of the frame when the insert is disposed within the hollow core;

a side display panel having a front side and a back side, the side display panel including a plane that intersects the plane of the display panel, wherein the side wall of the structural member is parallel to the plane of the side display panel when the side display panel is positioned on the side wall; and a ferromagnetic material affixed to the back side of the side display panel, wherein the back side of the side display panel engages the side wall of the structural member such that the side display panel is magnetically coupled to the insert through the side wall.

15. The display system of claim 14 wherein an edge of the side display panel abuts an edge of the display panel to form a substantially seamless joint.

* * * * *